United States Patent [19]

Walden, Jr. et al.

[11] Patent Number: 4,894,647

[45] Date of Patent: Jan. 16, 1990

[54] SCINTILLATING HANDLE FOR BEVERAGE TAP

[75] Inventors: Donald M. Walden, Jr., Franklin; John P. Glueckstein, Hubertus, both of Wis.

[73] Assignee: Everbrite Electric Signs, Inc., Greenfield, Wis.

[21] Appl. No.: 142,026

[22] Filed: Jan. 11, 1988

[51] Int. Cl.[4] ..... G09G 3/00

[52] U.S. Cl. ..... 340/815.200; 40/332

[58] Field of Search ..... 340/815.01, 815.03, 340/815.16, 815.2, 726, 762, 782, 792, 309.4; 40/332, 442, 463, 464

[56] References Cited

U.S. PATENT DOCUMENTS

| | | | |
|---|---|---|---|
| 2,295,468 | 9/1942 | Haley | 40/332 |
| 2,631,393 | 3/1953 | Hetherington | 40/332 |
| 3,286,385 | 11/1966 | Tate, Jr. | 40/332 |
| 3,321,861 | 5/1967 | Tate, Jr. | 40/332 |
| 3,934,249 | 1/1976 | Sanjana | 40/442 |
| 4,001,810 | 1/1977 | Olsen | 40/442 |
| 4,229,893 | 10/1980 | Uys Naude | 40/463 |
| 4,501,422 | 2/1985 | Leshik | 273/1 GC |

*Primary Examiner*—Donald J. Yusko
*Assistant Examiner*—Edwin C. Holloway, III
*Attorney, Agent, or Firm*—Fuller, Puerner & Hohenfeldt

[57] ABSTRACT

A handle for operating a beverage tap has an array of light emitting diodes (LEDs) mounted to it. an electronic control circuit is mounted in the handle and lead wires run out of the handle from said control circuit to a source of electric power. A switch closes when the handle is tilted to activate the control circuit and the control circuit responds by energizing the LEDs and causing them to scintillate in a predetermined sequence.

2 Claims, 3 Drawing Sheets

SCINTILLATING HANDLE FOR BEVERAGE TAP

BACKGROUND OF THE INVENTION

The invention disclosed herein is a beverage tap operating handle which scintillates when it is tilted to open the tap for dispensing a beverage.

It is commonplace for taps used for dispensing beer, soft drinks and the like to be decorated and to bear the trade name of the product being dispensed. In taverns where there are several adjacent taps for dispensing competitive brands of beer, for example, customers can be influenced to call for a certain brand if they get the impression that others are buying it frequently or if the brand name is simply brought to the attention of customers frequently. One competitor can obtain an advantage over others if, each time a beverage is drawn, there is some way to induce customers to notice it.

SUMMARY OF THE INVENTION

The invention disclosed herein makes operation of a beverage tap conspicuous by providing a tap handle which scintillates for a predetermined amount of time each time the handle is operated to cause dispensing of one of the available beverages.

Briefly stated, the new tap handle comprises a casing having means for threadingly attaching it to the operating lever of a beverage dispensing tap, for example. On at least one face of the casing there is an array of light emitting elements such as light emitting diodes. These elements can be arranged in the manner of a border or they can be arranged in other patterns which, hopefully, maximize attractiveness of the tap handle when the elements are cyclically illuminated and darkened. In the illustrative embodiment, there is a printed circuit board mounted within the casing and it contains electronic circuitry for controlling or sequencing the light emitting elements. A miniature tilt switch is mounted to the circuit board and, when the tap handle is tilted for the purpose of dispensing a beverage, the switch closes and activates the electronic circuitry so the latter outputs the electric signals for causing selected ones of the light emitting elements to switch from light to dark and vice versa in preselected patterns governed by the logic of the electronic circuit, in which case the attention of customers is attracted to the tap handle much more than if it did not scintillate for a time interval each time the tap is operated.

A more detailed description of illustrated embodiments of the new scintillating tap handle will now be set forth in reference to the drawings.

DESCRIPTION OF A PREFERRED EMBODIMENT

Figure 1:
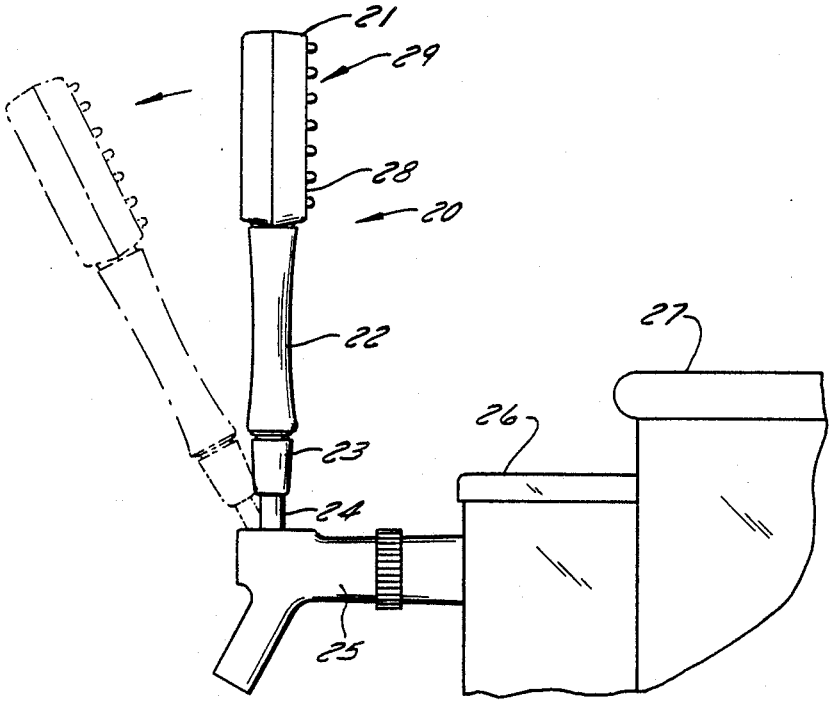
FIG. 1 is a side elevation view of a beverage dispensing tap to which the new scintillating handle has been attached, the handle being shown in its upright or inactive position in solid lines and in its tilted or active scintillating position in phantom lines.

Referring to FIG. 1, the new scintillating tap handle is designated generally by the reference numeral 20. The handle comprises a casing 21 from which a stem 22 extends. The lower end of the stem has a coupling portion or ferrule 23 which is internally threaded for screwing the handle on to the operating lever 24 of a beverage tap 25. The beverage dispensing tap 25 is supplied with beverage from a pressurized container 26 which is mounted on one side of a counter or bar such as is commonly used at soda fountains and taverns. On the rear face 28 of casing 21 there is an array of light emitting elements such as light emitting diodes which are collectively designated by the numeral 29. In one embodiment described herein to illustrate the principles of the invention, the light emitting diodes 29 (hereafter called LEDs) are all dark or turned off when the handle is upright as shown in solid lines in FIG. 1 which upright position corresponds to the LEDs being inactivated. When the handle 20 is tilted to dispense a beverage as indicated in phantom lines in FIG. 1, the electronic circuitry is activated and the LED array 29 begins to execute its scintillation pattern. In this particular embodiment, as will be explained in greater detail later, scintillation occurs during all of the time that the handle is tilted and for several seconds, such as up to ten seconds, after the handle is restored to untilted or upright position.

Figure 4:
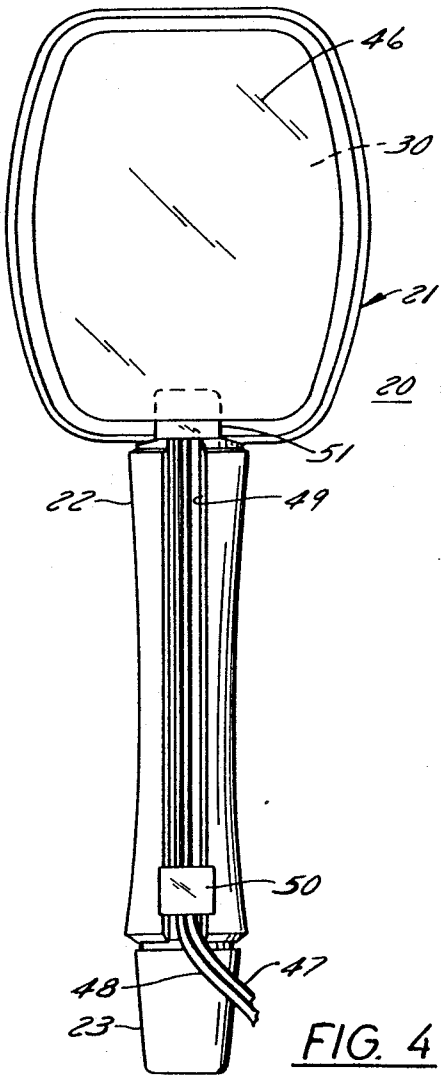
FIG. 4 is a rear view of the scintillating handle, showing the electric wires connected thereto.
Figure 3:
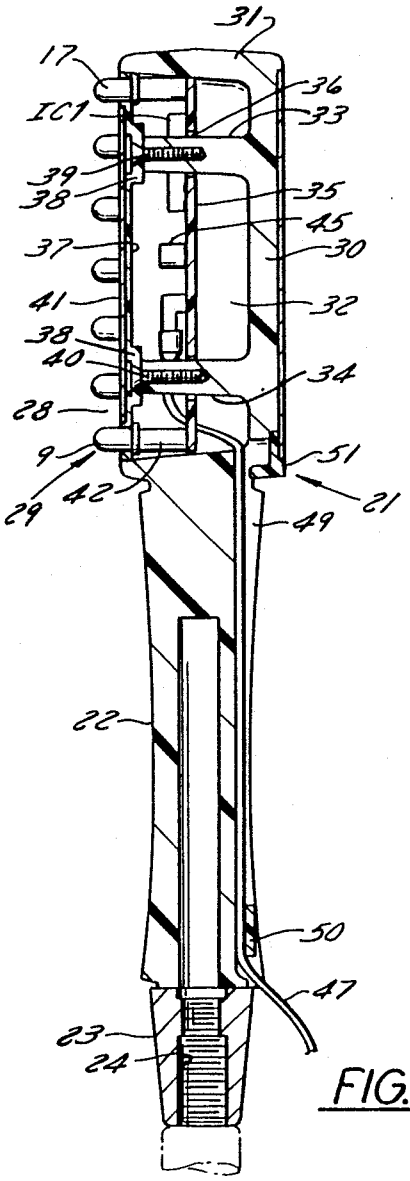
FIG. 3 is a vertical section taken on a line corresponding with 3—3 in FIG. 2.
Figure 2:
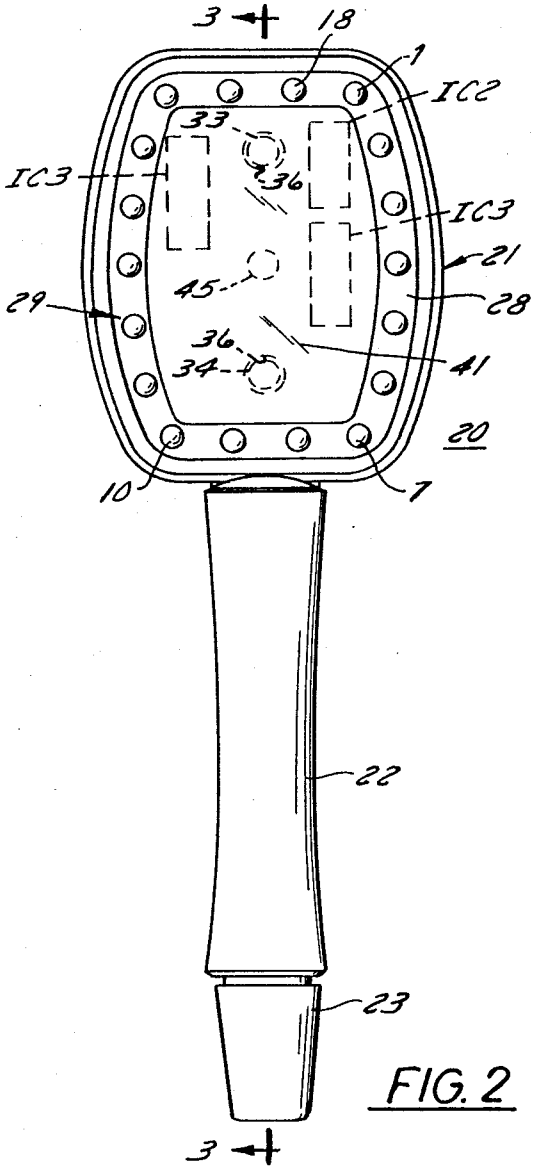
FIG. 2 is a front elevation view of the scintillating tap handle.

Attention is now invited to FIGS. 2–4 for an explanation for how the scintillating tap handle is constructed. The casing 21 and the stem 22 are molded from a plastic material in one piece. As is evident in FIG. 3, the backside 30 of the handle is integral with side walls such as the one marked 31 to define a cup-like cavity 32. There are tapered posts 33 and 34 extending integrally from the backside 30 of the casing and there is a circuit board 35 supported on the posts. The board has holes such as the one marked 36 for slipping over the tapered posts and wedging tightly. There is a bezel or rigid front plate 37 which sets into cavity 32 so as to be flush with its face. Bezel 37 serves as a closure for the cavity in the casing. The bezel has pads such as the one marked 38 molded with it. These pads have holes through which tapered headed screws 39 and 40 pass for tightening bezel 37 to the casing in a sealing fashion. A decal 41 may be applied to the bezel. Typically, the decal will have product identifying indicia or some other ornamental matter printed on it. The decal also conceals the heads of the hold down screws 39 and 40.

FIG. 3 shows clearly how a typical one LED 9 of the light emitting diodes is mounted to the printed circuit board. These assemblies are comprised of an LED, such as the one marked 9 which emits light when electrically energized, and a cylindrical base tube 42. LED bases such as the one marked 42 have the lead wires, not visible, for the LED 9 extending through them and these leads are soldered to the board and to conductive stripes on the board so they become firmly physically anchored and serve as leads to the electrodes of the LEDs. The LEDs, of which there are eighteen in this illustrative embodiment, pass snugly and sealingly through the bezel.

By inspecting FIGS. 2 and 3, one may see that there is a miniature tilt switch 45 mounted to the circuit board 35. This is a commercially available mercury-type tilt switch. FIG. 2 also shows that there are three integrated circuits IC1, IC2 and IC3 mounted to circuit board 35. Their function will be described later in reference to the FIG. 11 circuit diagram.

Figure 5:
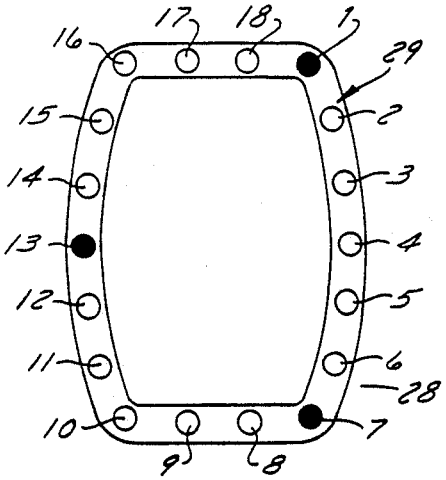
FIGS. 5–10 are provided for illustrating one way in which a serial array of light emitting elements can be selectively energized or darkened to create the illusion of the elements being in motion or circulating in a closed loop pattern.

In FIG. 2, the eighteen LEDs begin with the one marked 1 and proceed in the clockwise direction to end with LED 18. In FIG. 5, reference numerals have been applied to all of the LEDs.

FIG. 4 shows the backside of the scintillating handle assembly. The back 30 of the casing is covered with a decal 46 which typically bears advertising information or a decorative pattern or identification of the product that is dispensed from the tap which is operated by the scintillating handle.

FIGS. 3 and 4 show how the pair of electric power input lead wires 47 and 48 are disposed in a channel 49 which runs along the stem 22 of the handle so the lead wires are inset. Wires 47 and 48 supply electric power to the printed circuit board. Wires 47 and 48 lead to a well known type of AC adaptor, not shown, which plugs into a 120 volt AC outlet usually and outputs 12 volts DC in this example. The lead wires 47 and 48 are secured in channel 49 by means of a tab 50 which is glued in place to captivate the lead wires. At the place where stem 22 junctions with the casing 21, there is another angular tab 51 which is glued in place to further assist in securing the lead wires in channel 49 and taking the stress off of the connection between the lead wires and the printed circuit board.

Figure 6:
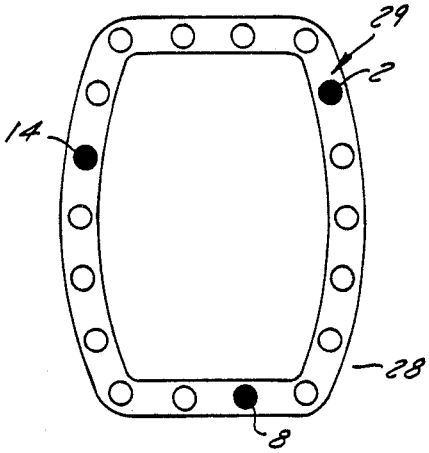
Figure 7:
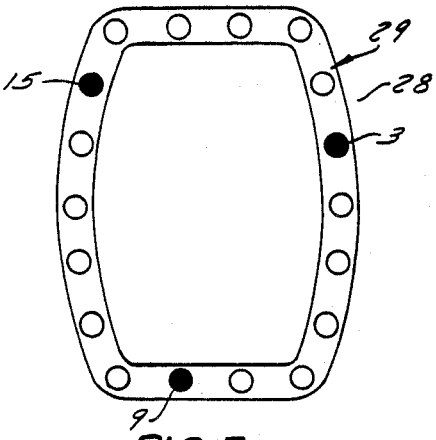
Figure 8:
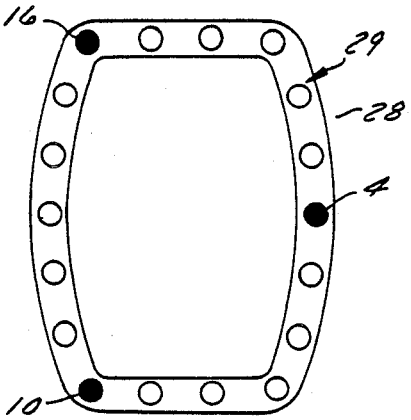
Figure 9:
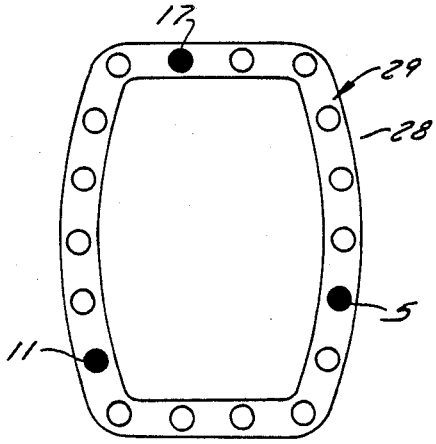
Figure 10:
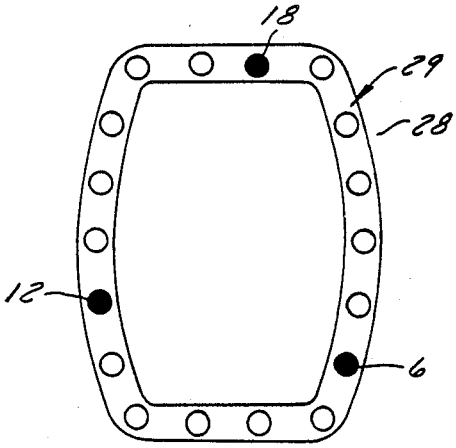

Refer now to FIGS. 5–10 which show the front side of the tap handle, that is, the side which is visible to customers who may be standing on the outside of a bar or beverage serving counter. One operating mode will be described in reference to FIGS. 5–10 but it will be understood by those skilled in the art that various scintillation schemes or illuminated display schemes can be programmed with various types of integrated circuits. In the illustrated example, the illusion of having dark dots chase each other around a closed loop is achieved. This is done by darkening three LEDs at a time and sequencing around the eighteen LEDs arranged in a closed loop. For example, in FIG. 5, LEDs 1, 7 and 13 are dark for a moment and all other of the 18 LEDs are illuminated or light and bright. After a short interval, LEDs 1, 7 and 13 are energized and LEDs 2, 8 and 14 become dark as indicated in FIG. 6. After a moment, LEDs 2, 8 and 14 turn on and LEDs 3, 9 and 15 become dark as indicated in FIG. 7. When these LEDs have been dark for a moment, they turn on and LEDs 4, 10 and 16 become dark as indicated in FIG. 8. When these LEDs turn on again, LEDs 5, 11 and 17 become dark as in FIG. 9. In a moment, these LEDs become bright again and LEDs 6, 12 and 18 go dark. This is the end of one operating cycle, after which there is a return to the starting condition which is exhibited in FIG. 5.

With the LEDs arranged in a closed loop as in FIGS. 5–10, a variety of scintillation sequence can be achieved besides the one that has been discussed in detail. For instance, instead of having three spaced apart LEDs go dark in sequence while all other LEDs are light, the reverse situation could be created wherein the three LEDs under consideration would turn on or go bright together while all other LEDs would be turned off or dark. Pairs of LEDs could also be caused to turn dark or light, in which case, using FIG. 5 for exemplification, LEDs 1 and 2, 7 and 8, and 13 and 14 might go dark together to begin an operating cycle and adjacent pairs of LEDs could turn on or off together while following around the loop.

Another example of an LED pattern, not shown, is where a group of LEDs are arranged in two concentric circles, while they are darkened in a sequence or in opposite directions which results in a scintillation action pattern that is highly attractive or attention getting. In the embodiment described in FIGS. 5 and 10, the cyclically darkened LEDs advancing in the same direction around the loop give the impression to some that all of the LEDs are rotating about the loop and to others that the black dots are chasing each other around the loop.

Figure 11:
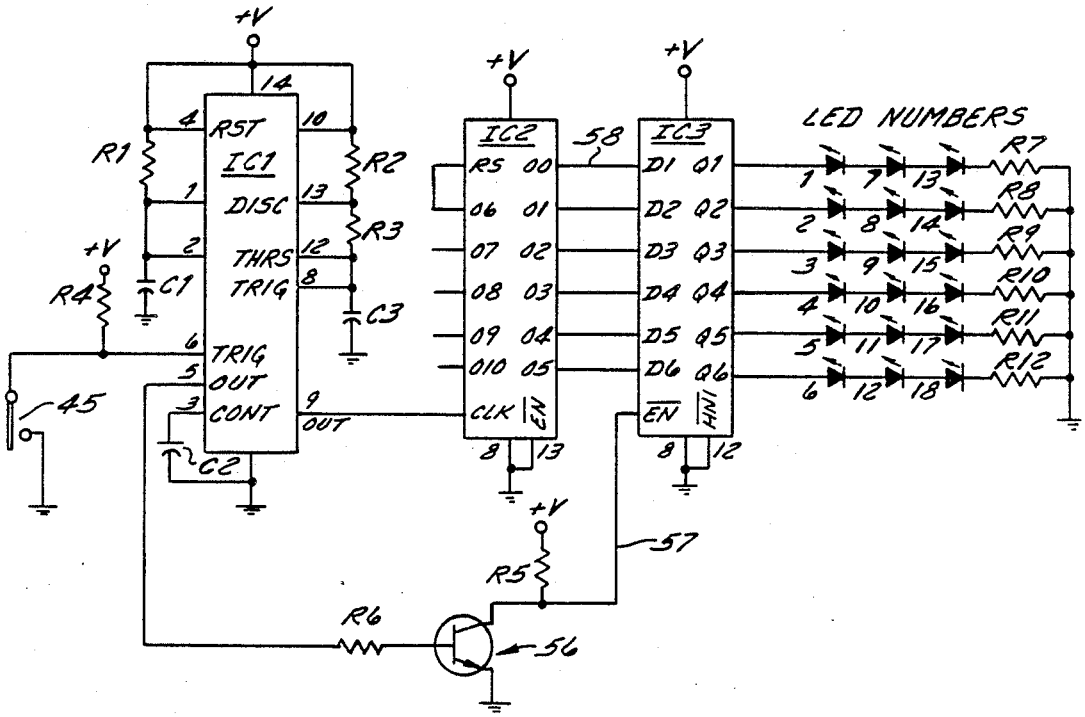
FIG. 11 is a diagram of the electronic circuit means which are attached to a circuit board and mounted in the handle and which can be variously programmed to cause the light emitting elements on the tap handle to scintillate and darken in various sequences or patterns.

Refer now to FIG. 11 for a description of one kind of electronic circuit means for making the tap handle scintillate. In FIG. 11, integrated circuit IC1 is a dual timer IC such as type 556. IC2 in this example is a Decade Counter/Divider type MC14017B. IC3 is a Strobed Hex Inverter/Buffer-type MC14502B. Other commercially available IC types can be substituted to obtain the same performance characteristics as is evident to those skilled in the electronic arts. The Hex inverter/buffer IC3 is being used because the illustrative operating mode is to have three dark LEDs chasing around at a time while all other LEDs are bright for the moment.

In FIG. 11, a DC voltage is applied to pin 14 of IC1. There are two timing circuits. One timing circuit on the left side is comprised of resistor R1 and capacitor C1. The top of R1 is connected to reset (RST) pin 4. The bottom of R1 is connected to discharge (DISC) pin 1. Timing capacitor C1 is connected on one side to ground and on the other side to threshold (THRS) sensing pin 2. Control (CONT) pin 3 is grounded through capacitor C2. The combination of R1 and C1 forms a timing circuit which causes output (OUT) pin 5 to go to a logical high level when a trigger signal is applied to (TRIG) pin 6. Pin 6 is held normally high by reason of it being connected through a resistor R4 to a voltage source +V. Trigger pin 6 is caused to change state to a lower logic level when the bottom end of R4 is grounded by reason of tilt switch 45 closing in response to the tap handling being tilted for the purpose of dispensing beverage from the tap. When pin 6 is triggered, output pin 5 goes high and stays high as long as tilt switch 45 remains closed. When tilt switch 45 opens due to restoring the tap handle to inactive position, output pin 5 of IC1 will remain high for some length of time such as eight or ten seconds after the switch is open. This means that scintillation will continue for that length of time after the handle is restored to inactive or upright or vertical position.

The right side of IC1 also has a timing circuit connected to it. The timing circuit is comprised of series connected resistors R2 and R3 and capacitor C3. The resistors are connected to the +V voltage source and to the capacitor which is also connected to ground. The resistors are connected to reset pin 10, discharge pin 13, threshold sensing pin 12, and trigger pin 8. The connections to the right side of IC1 cause this IC to act as a free running multivibrator which produces a square wave output on pin 9 and serves as a clock pulse generator. The pulse or step rate is dependent on the the values of the resistors R2, R3 and capacitors C3. In a commercial embodiment wherein the dark LED dots are caused to chase each other around a loop at a reasonable speed, the pulse rate on output pin 9 is about 14 Hz. The free running pulse output from pin 9 serves as a clock pulse train to decade counter/divider IC2. The clock pulses are fed to the pin of IC2 marked CLK. IC2 is always enabled since its pin 13 is connected to ground and enabling requires an active low signal. The long duration time interval corresponding to output pin 5 of IC1 switching to a high logic state is fed through a limiting resistor R6 and then through the base-emitter circuit of a transistor 56. When the base of transistor 56 has a high logical level voltage applied to it, its collector-emitter circuit becomes conductive. The collector of transistor 56 is connected to the bottom of a resistor R5 whose top is connected to a voltage source +V. The collector is connected by way of a line 57 to the enable pin of strobed hex inverter/buffer IC3. Thus, when output pin 5 of IC1 goes high, transistor 56 causes this signal to go low and to be applied to the active low enable pin of IC3 so it will couple signals between its input pins and output pins.

When clock pulses are applied to the CLK pin of IC2, six of the output pins 00–05 switch one at a time in sequence from a logic low level to a logic high level. In other words, the outputs of counter IC2 are normally at a low logical level and only one output at a time is switched to a high logical level. When a pin such as 00 is high, the high logical level signal is applied by way of a line 58 to the data input pin D1 of strobed hex/inverter-buffer IC3. Since IC3 inverts, on the first clock pulse, when a high logical level signal is applied to its input pin D1, the corresponding output pin Q1 switches to a logical low level and LEDs 1, 3 and 13 turn off and go dark. On the second clock pulse, output pin 01 of IC2 would go to a high logical level and input pin D2 of IC3 would go to a correspondingly high logical level. Because of inversion in IC3, Q2 output pin goes to a low logical level, thus causing LEDs 2, 8, 14 to turn off and be dark while all other LEDs remain energized and bright. The process is repeated until output pin 05 of IC2 goes high and output pin Q6 of IC3 goes low so as to cause the last three LEDs 6, 12 and 18 to go low. The LED turn off or darkening sequence is shown in FIGS. 5–10 in the order of darkening as was previously discussed. Each of the series of three LEDs have current limiting resistors connected in series with them. These resistors are marked R7 to R12.

IC2 acts like a ring counter, it just recycles without delay. In the present example, the active low reset pin of IC2 is connected to output pin 06 which causes IC2 to reset after it has caused its output pin 05 to go high in response to a clock pulse. For this particular type, MC14017B decade counter/divider IC2, if the active low reset pin were connected to output pin 07, it would sequence around and every LED would go off and then there would be a period of time when all LEDs are on. The time during which all LEDs are on depends on which output the active low reset pin is connected to. If the reset pin is connected to output pin 07, all LEDs will be on for one clock pulse cycle at the end of an 00 to an 05 high logical level going sequence. If the reset pin of IC2 were connected to output pin 08, all LEDs would be on for two clock cycles before the groups of three LEDs would go dark in sequence again. If, for example, the reset pin were connected to output pin 010 of IC2, all LEDs would be on for five clock pulses before the groups of three would be darkened in sequence again.

It will be understood by those skilled in the art that it is possible to combine the functions of the three illustrated integrated circuits on a single chip so fewer connections would have to be made on the circuit board itself in which case, manufacturing costs could be reduced.

The number of different scintillation patterns that can be obtained is very large. An almost unlimited number of different LED arrangements can be devised. Skilled electronic designers will be able to devise LED programmable timing circuits to achieve scintillation activity that can be artistic as well as optically attractive.

Although an embodiment of the invention has been described in considerable detail, such description is intended to be illustrative, rather than limiting, for the invention may be variously embodied and is to be limited only by interpretation of the claims which follow.

We claim:

1. A scintillation device for operating a tap for dispensing liquid, said device comprising:

handle means and means for coupling said handle means to said tap such that when said handle means is tilted from an inactive position to an active position said tap is caused to open for dispensing a liquid, said handle means comprises a casing and a stem joined to said casing, said stem having said means for coupling said handle means to said tap, a display comprised of a plurality of electrically activated light emitting elements arranged in a pattern and mounted to said handle means, electronic circuit means mounted on said handle means and having electrical connections to said light emitting elements, said circuit means including switch means responsive to said handle means being tilted by closing to activate said circuit means to initiate repeatable scintillation sequences wherein said circuit means energizes some of said light emitting elements and concurrently deenergizes other of said elements cyclically, said circuit means being mounted in said casing, face plate means applied to said casing for enclosing the same, said light emitting elements projecting from said face plate means.

2. A scintillation device for operating a tap for dispensing liquid, said device comprising:

handle means and means for coupling said handle means to said tap such that when said handle means is tilted from an inactive position to an active position said tap is caused to open for dispensing a liquid, said handle means comprises a casing and a stem joined to said casing, said stem having said means for coupling said handle means to said tap, a display comprised of a plurality of electrically activated light emitting elements arranged in a pattern and mounted to said handle means, electronic circuit means mounted on said handle means and having electrical connections to said light emitting elements, said circuit means including switch means responsive to said handle means being tilted by closing to activate said circuit means to initiate repeatable scintillation sequences wherein said circuit means energizes some of said light emitting elements and concurrently deenergizes other of said elements cyclically, said circuit means being mounted in said casing, face plate means applied to said casing for enclosing the same, said light emitting elements projecting from said face plate means, said circuit means including a clock pulse generating means for generating a series of clock pulses when said switch is closed by tilting said handle means, pulse counter means having an input coupled to said clock pulse generator and having a plurality of power outputs, said counter means having another input connected to an electric power source, said counter means responding to occurrence of clock pulses by coupling said outputs, respectively, in a predetermined sequence to said electric power source, a plurality of circuits each containing at least one of said electrically activated light emitting elements, and a hex inverter/buffer for coupling said power outputs of the counter means respectively to said circuits containing said light emitting elements, said hex inverter/buffer having a plurality of inputs coupled to respective outputs of said counter means and having corresponding power outputs coupled to said light emitting element containing circuits, said inverter having an input connected to an electric power source, said inverter/buffer operating to uncouple at least one of said light emitting element containing circuits at a time from the electric power source so the light emitting elements in said one circuit at a time are deenergized and dark and the elements in the other circuits at the same time are energized and emitting light.

* * * * *